United States Patent [19]

Johnson

[11] Patent Number: 4,863,338

[45] Date of Patent: Sep. 5, 1989

[54] MATERIAL HANDLING BUCKET WITH EXTENSIBLE AND PIVOTALLY MOUNTED APRON ASSEMBLY

[76] Inventor: Bruce W. Johnson, Route 5, Box 204-I, Raleigh, N.C. 27604

[21] Appl. No.: 205,351

[22] Filed: Jun. 10, 1988

[51] Int. Cl.[4] ..... E02F 3/413

[52] U.S. Cl. ..... 414/704; 414/724; 414/725

[58] Field of Search ..... 414/704, 722, 724, 725; 37/117.5

[56] References Cited

U.S. PATENT DOCUMENTS

| | | | |
|---|---|---|---|
| 2,705,082 | 8/1953 | Heimsoth | 414/704 X |
| 2,768,760 | 10/1956 | Pilch | 414/722 |
| 3,336,684 | 8/1967 | Ulrich | 37/1175 |
| 3,451,575 | 6/1969 | Petro, Jr. | 414/704 |
| 3,455,477 | 7/1967 | Blair | 414/704 |
| 4,055,007 | 10/1977 | Johnson | 414/513 X |
| 4,155,473 | 5/1979 | Holopainen | 414/704 |
| 4,187,049 | 2/1980 | Jones | 414/704 |
| 4,407,626 | 10/1983 | Bruckner | 414/722 X |

OTHER PUBLICATIONS

John Deere "Farm Loader" Operator's Manual, OM-C12533C, 12/19/60.

*Primary Examiner*—Robert J. Spar
*Assistant Examiner*—William M. Hienz
*Attorney, Agent, or Firm*—Rhodes, Coats & Bennett

[57] ABSTRACT

The present invention relates to a material handling bucket of the type commonly used on a front-end loader. The bucket is provided with an apron assembly that includes an apron that is movable fore and aftly between a retracted position where the apron essentially closes the front opening of the bucket to an extended position where the apron is spaced forwardly from the front opening of the bucket. In addition, the apron and entire apron assembly is privotally mounted such that it can be hydraulically moved a generally horizontal position to a vertical position thereby providing clear access to the front opening of the bucket.

3 Claims, 3 Drawing Sheets

MATERIAL HANDLING BUCKET WITH EXTENSIBLE AND PIVOTALLY MOUNTED APRON ASSEMBLY

FIELD OF THE INVENTION

The present invention relates to material handling and to buckets of the type used on a front-end loader, and more particularly to a bucket having a front apron assembly.

BACKGROUND OF THE INVENTION

The typical bucket used on a front-end loader is a very versatile implement. It is ordinarily used to pick up, transport and dump materials such as dirt, rock, stone, etc.

However, while the conventional front-end loader bucket has been a very effective and efficient material handling device it does have its drawbacks and shortcomings. For example, it is often desirable to grab or retrieve a large tree or other type of structure or material that will not conveniently fit into the bucket itself. It is these cases where the bucket cannot function.

In addition, when scraping or picking up dirt it is always very difficult to retrieve the final mound or pile of dirt that lies just at the edge of the bucket's front blade edge. As the front blade is rotated upwardly in a retrieving operation, there is invariably a mound or dirt that lies unretrieved.

Therefore, there is and continues to be a need for a move versatile bucket that will enable the bucket to more efficiently retrieve materials, even materials that will not conveniently fit within the confines of the bucket.

SUMMARY AND OBJECTS OF THE INVENTION

The present invention entails a very versatile and efficient bucket design that is aimed at overcoming the disadvantages and shortcomings of conventional front-end loader type buckets. In particular, the bucket of the present invention includes an apron assembly that is pivotally mounted on a pair of arms that extend over the top of the bucket. The apron assembly includes a front apron that is movable back and forth from a position where it essentially closes the font opening of the bucket to an extended position where the apron lies forwardly of the front opening of the bucket.

The apron may be actuated so as to cooperate with the bucket to retrieve and pick up logs, tree trunks, etc. In addition, it is appreciated that in loading material into the bucket that the apron can be actuated to actually pull material into the bucket.

It is therefore a primary object of the present invention to provide a bucket with a front mounted apron assembly that is both movable fore and aftly in front of the bucket and which can be moved from a horizontal operative position to a vertical position where the apron assembly lies away from the bucket itself.

A further object of the present invention is to provide a bucket assembly with an apron assembly of the character referred to above wherein the apron assembly is of a simple, sturdy design and which can be actuated and controlled through a hydraulic control system.

A further object of the present invention resides in the provision of a bucket of the character referred to above that is provided with an apron assembly that is designed to cooperate with the bucket such that trees and the like can be grabbed between the apron and the leading edges of the bucket such that such material can be transported from one location to another.

Still a further object of the present invention resides in providing a bucket of the type having an ejector blade with a pivotally mounted and extensible apron assembly.

Other objects and advantages of the present invention will become apparent and obvious from a study of the following description and the accompanying drawings which are merely illustrative of such invention.

DETAILED DESCRIPTION OF THE INVENTION

Figure 1:
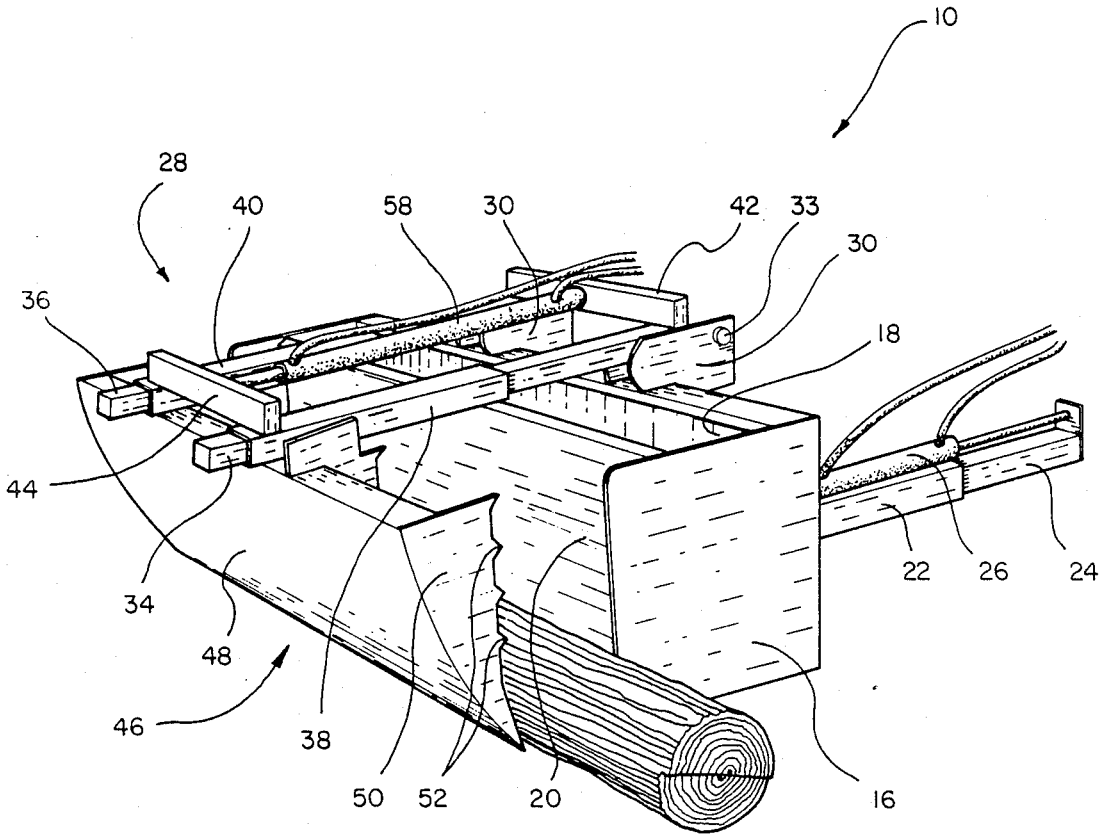
FIG. 1 is a perspective view of the material handling bucket of the present invention illustrating the apron assembly cooperating with the leading edges of the bucket to carry an elongated tree or log.

With further reference to the drawings, the bucket of the present invention is shown therein and indicated generally by the numeral 10. Viewing bucket 10 it is seen that the same includes a bottom 12, a front cutting edge 14 formed along the front edge of the bottom 12, a pair of side walls 16 and a back 18. It is thusly appreciated that there is defined an open front and an open top about the bucket 10.

Figure 5:
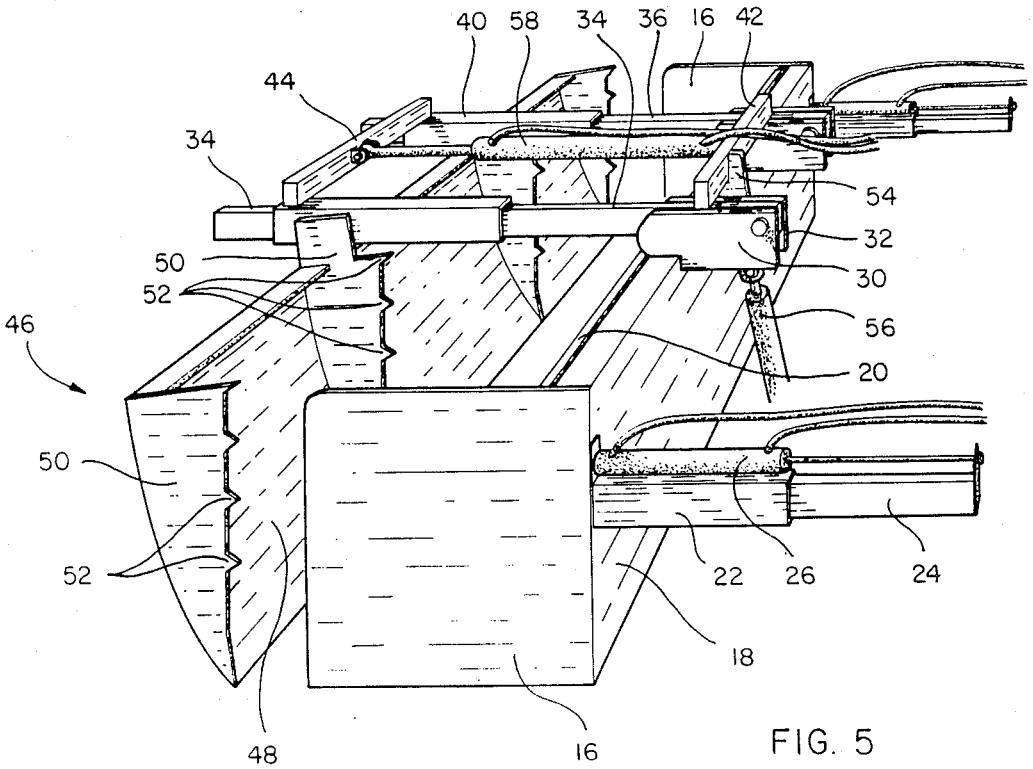
FIG. 5 is a perspective view of the bucket and apron assembly with the apron assembly being disposed in a horizontal extended position.

Bucket 10 further includes an ejector blade 20 that is movably mounted within the bucket 10. A pair of pusher rods 24 (FIG. 5) are secured to the back side of ejector blade 20 and project rearwardly therefrom through the back wall 18 of bucket 10. Pusher rods 24 project through a pair of rigid guide sleeves 22 formed on the back 18. It is appreciated that the length of the pusher rods 24 would extend sufficiently from the rear of the bucket 10 so as to enable the ejector blade 20 to move to a forward extended position where the ejector blade 20 would lie about the open front of bucket 10. To power ejector blade 20 there is provided a double acting hydraulic cylinder 26 operatively interconnected between each pusher rod 24 and a respective guide sleeves 22.

Figure 4:
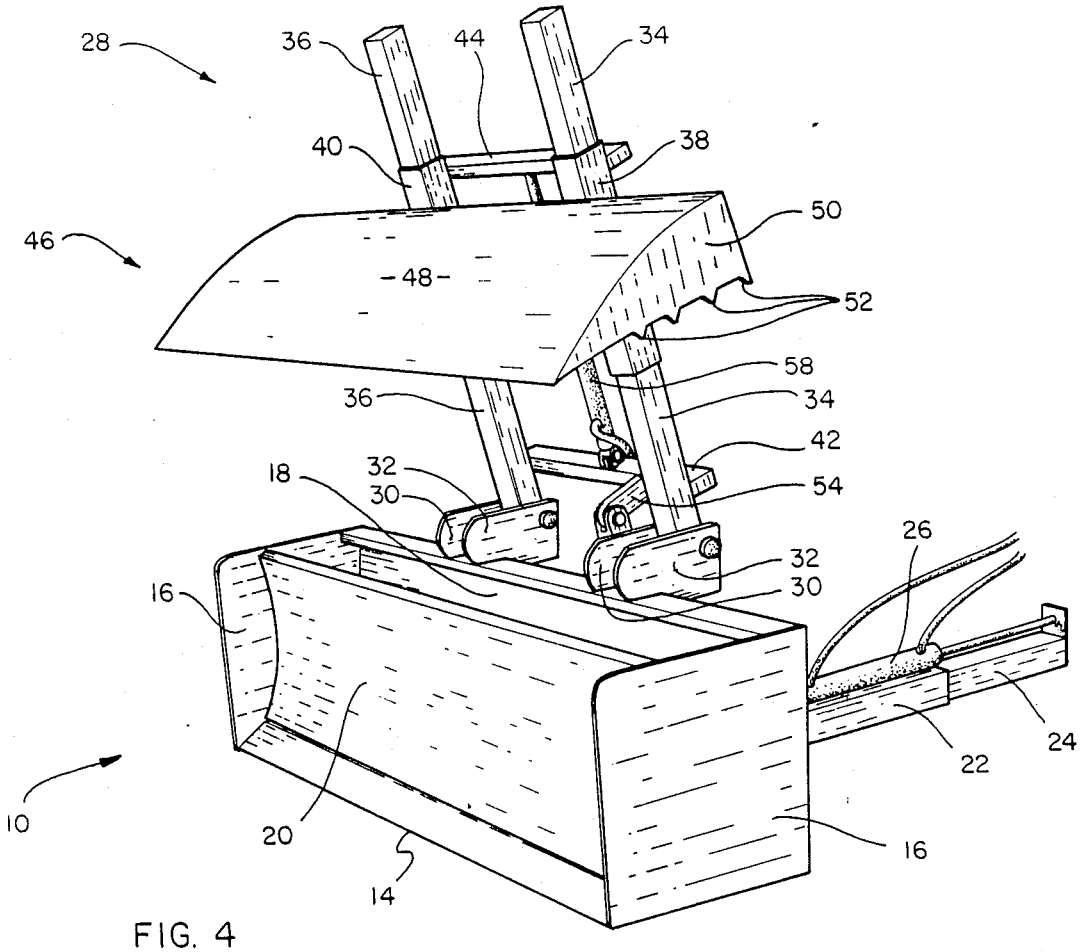
FIG. 4 is a perspective view showing the apron assembly in a vertical raised position.

Mounted about the upper rear portion of bucket 10 is an apron assembly indicated generally by the numeral 28. As will be understood from subsequent portions of this disclosure, the apron assembly 28 is both extensible and pivotally mounted. In particular, the apron assembly 28 can be pivoted from a generally horizontal operative position, FIG. 1, to a vertical raised position as shown in FIG. 4.

Viewing apron assembly 28 in detail it is seen that the same is mounted to the bucket 10 by two sets of mounting plates, each set including plates 30 and 32. Pivotally mounted between the mounting plates 30 and 32 is a pair of laterally spaced arms 34 and 36. Arms 34 and 36 are pivotally mounted between respective plates 30 and 32 by a pivot pin 33.

Axially movable on the arms 34 and 36 is a pair of sleeves 38 and 40. In particular, sleeves 38 and 40 encompass the arms 34 and 36 and are slidable therealong.

A rear cross member 42 is interconnected between arms 34 and 36 about a rear portion of the bucket 10. A front cross member 44 is interconnected between the sliding sleeves 38 and 40.

An apron 46 is mounted to the sleeves 38 and 40 and depends generally downwardly therefrom. Apron 46 comprises a back pulling blade 48 that extends across the front of bucket 10. Back pulling blade 48 includes a plurality of laterally spaced carrier plates 50, the carrier plates 50 being quite agressive as they include a series of vertically spaced teeth 52.

Extending downwardly from the rear cross member 42 is a crank arm 54 that is operatively connected to a lift cylinder 56.

To actuate the apron 46 and particularly to move the same for and aftly on the arms 34 and 36 there is provided a double acting hydraulic cylinder 58 that is connected between the rear cross member 42 and the front cross member 44.

Details of the bucket connecting mechanism is not dealt with herein in detail because such is not per se material to the present invention and because such connecting structures are standard and well-known in the art.

In operation, it is appreciated that the apron assembly can assume either a generally horizontal operative position as shown in FIG. 1 or a raised or elevated position as shown in FIG. 4. In the raised or elevated position shown in FIG. 4, the apron assembly 28 assumes a position remote from the front open end of the bucket 10 and consequently the bucket 10 can be used in a conventional fashion.

Figure 2:
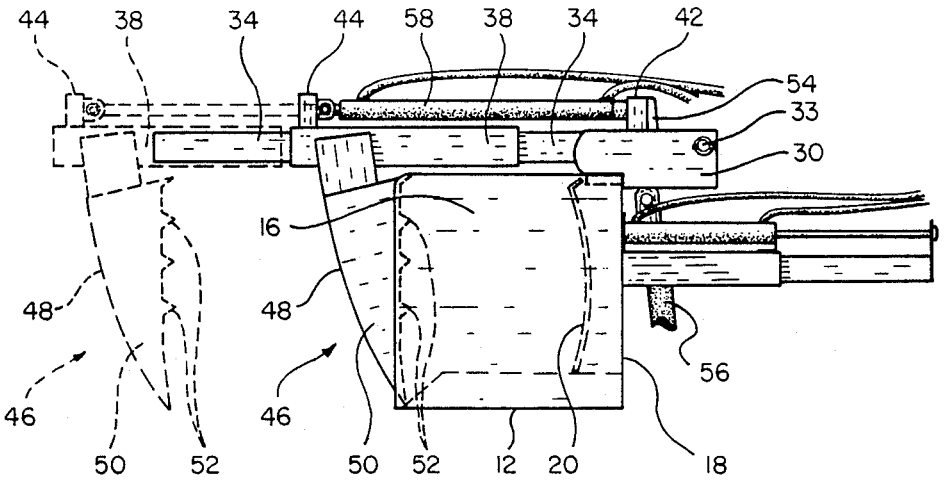
FIG. 2 is a side elevational view of the bucket and apron assembly with the apron assembly being shown in the extended position in dotted lines.
Figure 3:
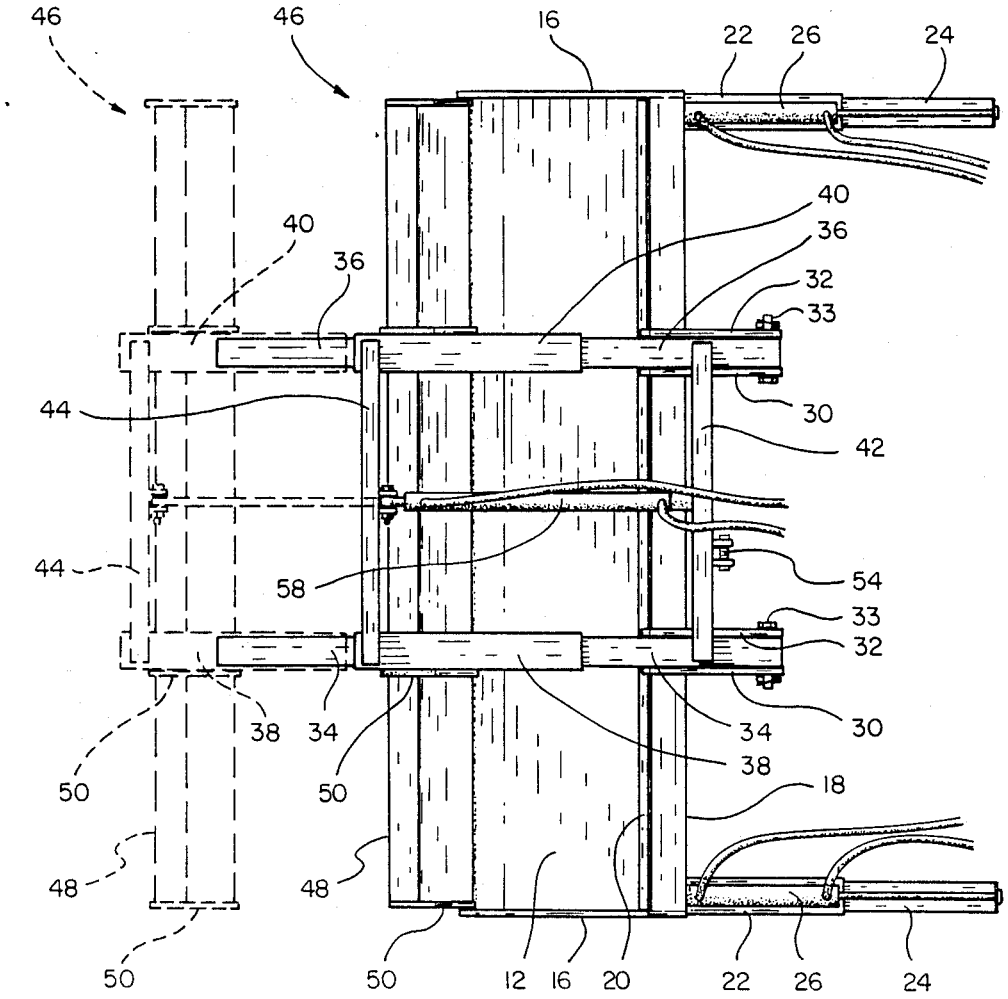
FIG. 3 is a top elevational view of the bucket shown in FIG. 2.

In the generally horizontal operative position, it is seen that the back pulling blade 48 can be moved from a retracted position shown in full lines in FIG. 2 to an extended position shown in dotted lines in FIG. 2. By simply actuating extensible cylinder 58 it is seen that the apron assembly and the apron blade itself can be moved fore and aftly. As particularly illustrated in FIG. 1, this enables the bucket and apron assembly to retrieve, transport and unload such items as logs, trees or any object that will fit within the space defined by the carrier plates 50 and the front terminal edge of the bucket 10.

In addition, the apron assembly 28 can be utilized to pull dirt, rock, stone or any material into the bucket 10 during a loading operation. This greatly increases the efficiency of the bucket as the apron assembly 28 will assist in pulling greater quantities into the bucket. Consequently, by using the apron assembly in a loading operation a greater quantity of material can be loaded into the bucket and consequently a more efficient hauling operation is achieved.

It is also appreciated that the ejector blade 20 can be utilized to assist in removing material from the bucket 10 during an unloading operation. When the ejector blade 20 is all the way forward and the apron assembly is in the vertical position such as in FIG. 4, the bucket can be used as a dozer blade.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In a bucket of the type typically mounted to a front end loader and having a closed bottom, back wall, and opposite sides, and a front opening, the improvement comprising an extensible and pivotally mounted apron assembly mounted to the bucket comprising:

(a) a pair of laterally spaced mounting plates secured to the back wall and projecting rearwardly from the back wall a predetermined distance;

(b) a pair of laterally spaced arms pivotally mounted to the mounting plates about a fixed axis that is spaced substantially rearwardly from the back wall of the bucket; the mounting plates resting on the top of the back wall and extending rearwardly therefrom, the fixed axis lying above the top of the back wall;

(c) means for pivotally mounting the arms for movement between a generally horizontal position where they extend forwardly from the back wall substantially past the front opening of the bucket to a generally raised vertical position;

(d) sleeves movably mounted on the arms and slidable therealong between a retracted position and an extended position;

(e) a first cross member secured transversely between the arms about rear end portion of the arms;

(f) a second cross member secured between the sleeves and spaced forwardly of the first cross member;

(g) an apron secured to the sleeves and movable therewith from an extended position where the apron is spaced outwardly from the front opening of the bucket to a retracted position where the apron lies adjacent the front opening of the bucket and generally closes the front portion of the bucket; the apron including a closed front wall and a pair of closed sides that project rearwardly from the front wall, and wherein each closed side includes a series of vertically spaced teeth that project rearwardly from each side; and wherein when the apron assumes a closed position the apron closes the front opening of the bucket as the sides of the apron move to a position closely adjacent the opposite sides of the bucket and the teeth of the sides project rearwardly past the forward edges of the opposite sides of the bucket so as to form an open top bucket and apron enclosure with closed sides; and (h) a hydraulic cylinder operatively connected between the first and second cross member for moving the apron between its extended and retracted positions, so as to operate the apron and bucket as a gripper for grasping and transporting articles.

2. The improved bucket of claim 1 wherein each of the laterally spaced pivot arms is elongated and extends completely over the open top of the bucket.

3. The improved bucket of claim 1 further including an ejector blade movably mounted within the bucket and movable between a position adjacent the back wall and a position where the ejector blade lies adjacent the front opening of the bucket.

* * * * *